US005216769A

United States Patent [19]

Eakin

[11] Patent Number: 5,216,769

[45] Date of Patent: Jun. 8, 1993

[54] FOLDABLE BED

[76] Inventor: Byron C. Eakin, 3405 Ellenwood La., Tampa, Fla. 33618

[21] Appl. No.: 940,697

[22] Filed: Sep. 3, 1992

[51] Int. Cl.[5] ..... A47C 19/12

[52] U.S. Cl. ..... 5/620; 5/174; 5/904; 128/33

[58] Field of Search ..... 5/904, 620, 174; 128/33; 381/159

[56] References Cited

U.S. PATENT DOCUMENTS

| | | | |
|---|---|---|---|
| 1,109,406 | 9/1914 | Dolge | 5/620 X |
| 3,359,576 | 12/1967 | Pile | 5/620 X |
| 3,456,269 | 7/1969 | Goodman | 5/620 X |
| 4,023,566 | 5/1977 | Martinmaas | 5/904 X |
| 4,124,249 | 11/1978 | Abbeloos | 5/904 X |
| 4,190,738 | 2/1980 | Samuels | 381/159 X |
| 4,457,502 | 7/1984 | Beach | 5/620 X |
| 5,035,235 | 7/1991 | Chesky | 128/33 |
| 5,090,071 | 2/1992 | Bathrick et al. | 5/174 X |
| 5,097,821 | 3/1992 | Eakin | 128/33 |
| 5,143,055 | 9/1992 | Eakin | 128/33 |

*Primary Examiner*—Michael F. Trettel

*Attorney, Agent, or Firm*—Dominik, Stein, Saccocio, Reese, Colitz & Van Der Wall

[57] ABSTRACT

A foldable bed with sound generating capabilities comprising: a lower assembly formed of a leg section and a body section, a linear hinge coupling the sections for movement between an open orientation and a closed orientation, the lower assembly also including foldable legs; an upper assembly formed of a leg component and a body component, the upper assembly having a fixed central extent with a separation line overhanging the hinge, the upper assembly also having a torso extent, a thigh extent, a calf extent; a first adjuster coupling the torso extent and the body section, a second adjuster coupling the thigh extent and the leg section, a third adjuster coupling the calf extent and the leg section; covering associated with the upper assembly including a cushioning pad overlying the upper surfaces of the upper assembly; and a sound generating device in both the torso extent and the calf extent with the central extent and thigh extent forming an acoustical barrier therebetween, each sound generating device including a speaker with a baffle supporting the speaker and aperture extending through the baffle tending to equalize the pressures in the spaces on opposite sides of the baffle.

12 Claims, 4 Drawing Sheets

FOLDABLE BED

BACKGROUND OF THE INVENTION

1. Field of the Invention

This invention relates to an improved foldable bed, and more particularly, to a portable foldable bed adapted for portable human use to support a user and stimulate the supported user audially and tactilly.

2. Description of the Background Art

Devices adapted for supporting a person reclining thereon have been in production and use for many years. However, the structural complexity of devices able to support a person in a reclined position are typically massive assemblies that weigh hundreds of pounds. The shear size and bulk of conventional reclining devices prohibit their portability. Furthermore, as a level of adjustability is added to the reclining device, the impediments for portability increase exponentially due to increased weight, bulkiness and structural complexity. Therefore, it is highly desirable to have a portable adjustable, reclining, devise that is able to form a flat horizontal surface, as well as, being able to provide an adjustable portion for raising the torso of a person and elevation of a person's legs independent of the torso. However, until the invention of the present device there has never been an adjustable foldable bed that has been of a portable configuration.

Furthermore, music is known to be somehow soothing to the spirit as well as pleasing to the ear. It is widely believed that humans work or study better within a musical environment, and some types of music are considered relaxing. Many recent developments in sound generation and reproduction equipment have expanded the uses of music. Advances in technology have accentuated and facilitated music appreciation. Music by its very nature has a repetitive aspect. Further, this characteristic can be used for active and passive exercise. Music encourages such bodily activity as dancing and is now a common accompaniment to individual or group exercise programs. However, a form of passive exercise of "massage" often proves beneficial well-being and is enhanced by voluntary exercise, but if such active exercise is impracticable or is not well distributed throughout the body or is carried to excess massage provides healthy stimulation to the body.

Similarities between repetitive exercise, massaging movements, and various mechanical actions have led to numerous mechanized beds, chairs, and tables. Efforts have also been made to apply musical or other acoustic/sonic vibrations to more of the body than the ears. However, nobody besides the present inventor seems to understand that the degree of coupling between the musical or other acoustic vibrations and the body is critical or how to accomplish it for the benefits sought. Loose coupling and tight coupling are inoperative because the former does not vibrate the body enough and the latter vibrates it too much, except where the body support is affixed to an inert frame (nullifying the coupling). The problem is even more acute with beds and adjustable beds, where diverse parts of the body are being supported variously.

The present inventor's foldable adjustable bed replaces the deficiencies of the known art with new levels of portability, entertainment and passive exercise plus related benefits for persons so exposed. Such benefits are attainable in the present invention's foldable adjustable bed, by providing a portable foldable bed that enables the bed to adjust its orientation from a sitting or a semi-reclining through a horizontal recumbent position, with head, body, and limbs all being supported.

As illustrated by the known art, efforts are continuously being made in an attempt to improve foldable adjustable bed. No prior effort, however, provides the benefits attendant with the present invention. Additionally, the prior commercial techniques do not suggest the present inventive combination of component elements arranged and configured as disclosed and claimed herein.

The present invention achieves its intended purposes, objects, and advantages through a new, useful and unobvious combination of component elements, with the use of a minimum number of functioning parts, at a reasonable cost to manufacture, and by employing only readily available materials.

Therefore, it is an object of this invention to provide a foldable bed with sound generating capabilities comprising, in combination: a lower assembly formed of a leg section and a body section, each section having an upper surface and a lower surface, a linear hinge coupling the sections for movement between an open orientation wherein the sections lie in a common horizontal plane and a closed orientation wherein the sections lie parallel with each other, the lower assembly also including foldable legs movable between an open orientation wherein the legs extend downwardly from the lower surface and a closed orientation wherein the legs lie parallel with the lower surface; an upper assembly formed of a leg component and a body component, each component having an upper surface and a lower surface, the lower surface of the upper assembly positionable on the upper surface of the lower assembly with means to couple the upper and lower assemblies at a central region thereof, the upper assembly having a fixed central extent with a separation line overhanging the hinge, the upper assembly also having a torso extent pivotally secured to the central extent over the body section, the upper assembly also having a thigh extent pivotally secured to the central extent over the leg section, the upper assembly also having a calf extent pivotally secured to the thigh extent over the leg section; first adjustment means coupling the torso extent and the body section to vary the angle of the torso extent with respect to the body section, second adjustment means coupling the thigh extent and the leg section to vary the angle of the thigh extent with respect to the leg section, third adjustment means coupling the calf extent and the leg section to vary the angle of the calf extent with respect to the leg section and thigh extent; covering means associated with the upper assembly including a cushioning pad overlying the upper surfaces of the upper assembly and a single cloth encompassing essentially the entire upper assembly including the pad; and a sound generating device in both the torso extent and the calf extent with the central extent and thigh extent forming an acoustical barrier therebetween, each sound generating device including a speaker with a baffle supporting the speaker and aperture means extending through the baffle tending to equalize the pressures in the spaces on opposite sides of the baffle.

A further object of the invention is to reduce the weight and simplify the design of an adjustable bed to thereby make to foldable and, hence, to facilitate its portability.

A further object of the present invention is to enhance the overall exposure of a listener to musical vibrations despite shifting movement of the listener from and to a sitting position and a reclined position via an intermediate lying position.

Another object of this invention is to transmit musical vibrations to the body as well as to the ears of a listener, regardless of whether such listener is sitting or lying down.

A further object of the invention is to accomplish the foregoing objects in a completely portable foldable adjustable bed that is convertible from an upright through a reclining position to a flat horizontal position.

A further object of the present invention is to provide an adjustable foldable bed of a portable configuration that is easily moved from place to place.

A further object is to provide a portable bed that is easily folded for being moved from one location to another location and able to hold up the back of a person while allowing the person's legs to depend freely therefrom when in a certain orientation while being able to be further oriented in a totally horizontal orientation.

Other objects of this invention together with means for attaining the various objects will be apparent in the following description and the accompanying drawings of a preferred embodiment thereof, being presented by way of example rather than limitation.

The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The invention is defined by the appended claims with the specific embodiment shown in the attached drawings. For the purpose of summarizing the invention, the invention may be incorporated into a foldable bed with sound generating capabilities. The folding bed comprises a lower assembly. The lower assembly is formed of a leg section and a body section. Each section has an upper surface and a lower surface. Further, a linear hinge couples the sections for movement between an open orientation wherein the sections lie in a common horizontal plane and a closed orientation wherein the sections lie parallel with each other. The lower assembly also includes foldable legs. The legs are movable between an open orientation wherein the legs extend downwardly from the lower surface and a closed orientation wherein the legs lie parallel with the lower surface. Additionally, the folding bed includes an upper assembly formed of a leg component and a body component. Each component has an upper surface and a lower surface. The lower surface of the upper assembly is positionable on the upper surface of the lower assembly and includes means to couple the upper and lower assemblies at a central region thereof. Furthermore, the upper assembly has a fixed central extent. The central extent has a separation line overhanging the hinge. The upper assembly further includes a torso extent. The torso extent is pivotally secured to the central extent over the body section. The upper assembly also has a thigh extent pivotally secured to the central extent over the leg section. Furthermore, the upper assembly also has a calf extent pivotally secured to the thigh extent over the leg section. A first adjustment means couples the torso extent and the body section. The first adjustment means varies the angle of the torso extent with respect to the body section. A second adjustment means couples the thigh extent and the leg section to vary the angle of the thigh extent with respect to the leg section. Finally, a third adjustment means couples the calf extent and the leg section for varying the angle of the calf extent with respect to the leg section and thigh extent. Further, a covering means is associated with the upper assembly. The covering means includes a cushioning pad overlying the upper surfaces of the upper assembly and a single cloth encompassing essentially the entire upper assembly including the pad. Finally, the bed includes a sound generating device in both the torso extent and the calf extent. The central extent and thigh extent form an acoustical barrier therebetween. Each sound generating device includes a speaker with a baffle supporting the speaker. An aperture means extends through the baffle to equalize the pressures in the spaces on opposite sides of the baffle.

The foregoing has outlined rather broadly the more pertinent and important features of the present invention in order than the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent structures do not depart from the spirit and scope of the invention as set forth in the appended claims.

BRIEF DESCRIPTION OF THE DRAWINGS

For a fuller understanding of the nature and objects of the present invention, reference should be had to the following detailed description taken in conjunction with the accompanying drawings in which.

Similar reference characters refer to similar parts throughout the several Figures.

DETAILED DESCRIPTION OF THE INVENTION

Figure 1:
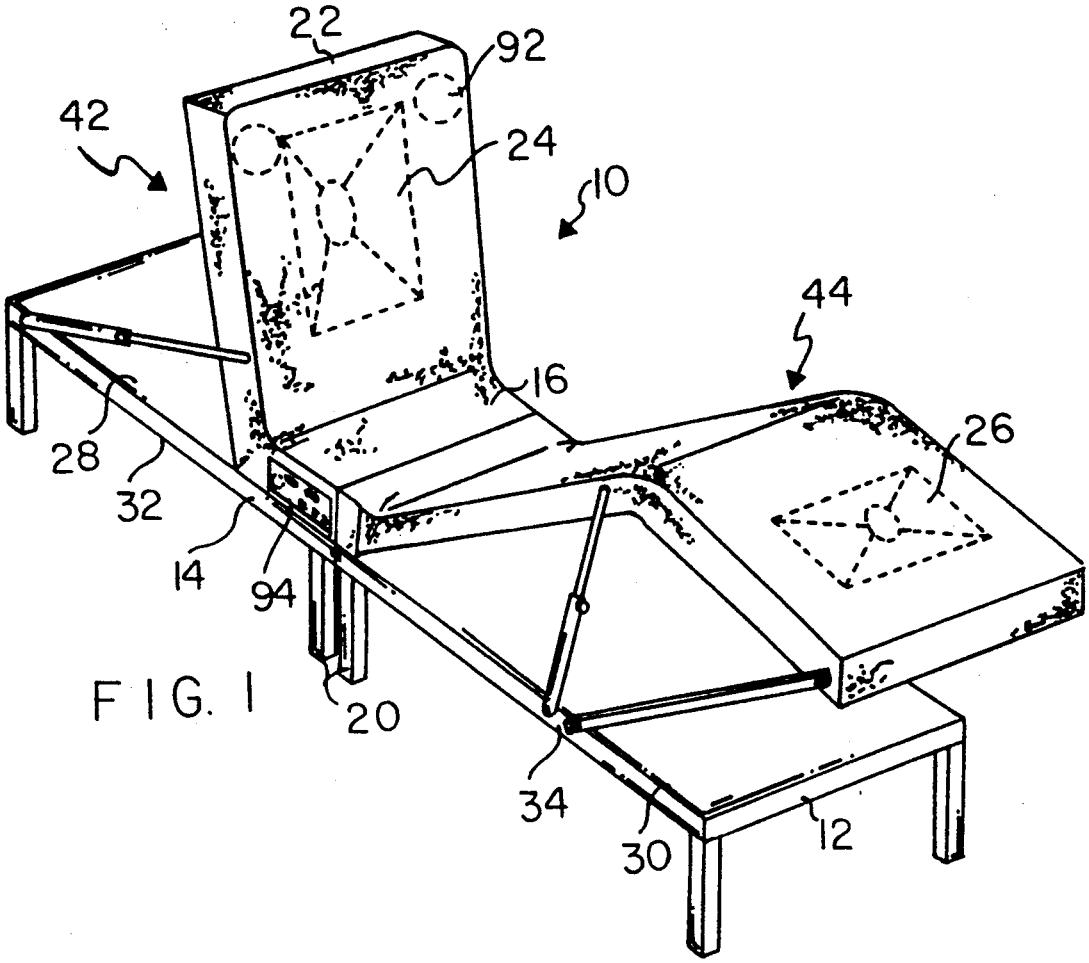
FIG. 1 is a perspective view of the primary embodiment of the folding bed constructed in accordance with the principles of the present invention.
Figure 2:
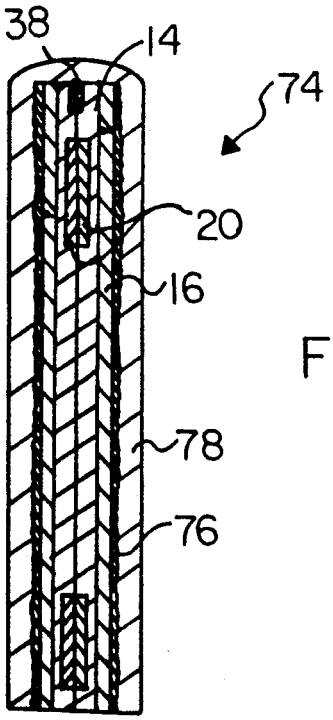
FIG. 2 is a cross section through the bed shown in FIG. 1 in a folded position.
Figure 3:
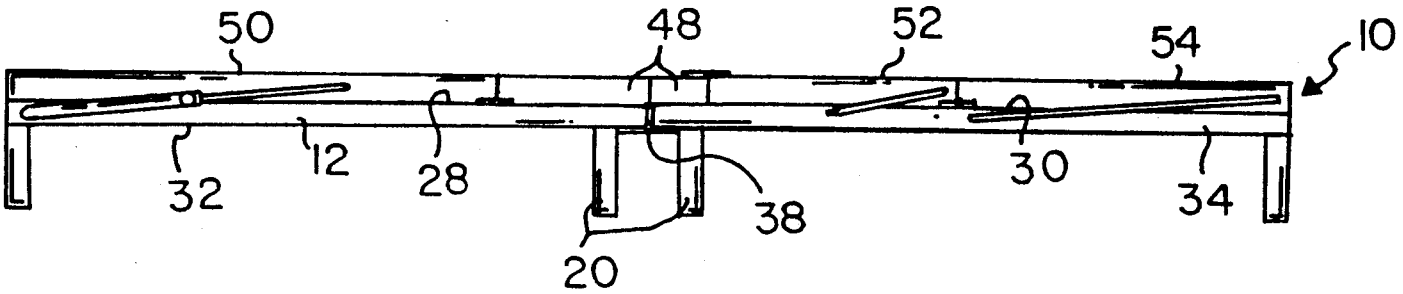
FIG. 3 is a side elevation of the primary embodiment of the bed with the body component and the leg component in a lowered position.
Figure 4:
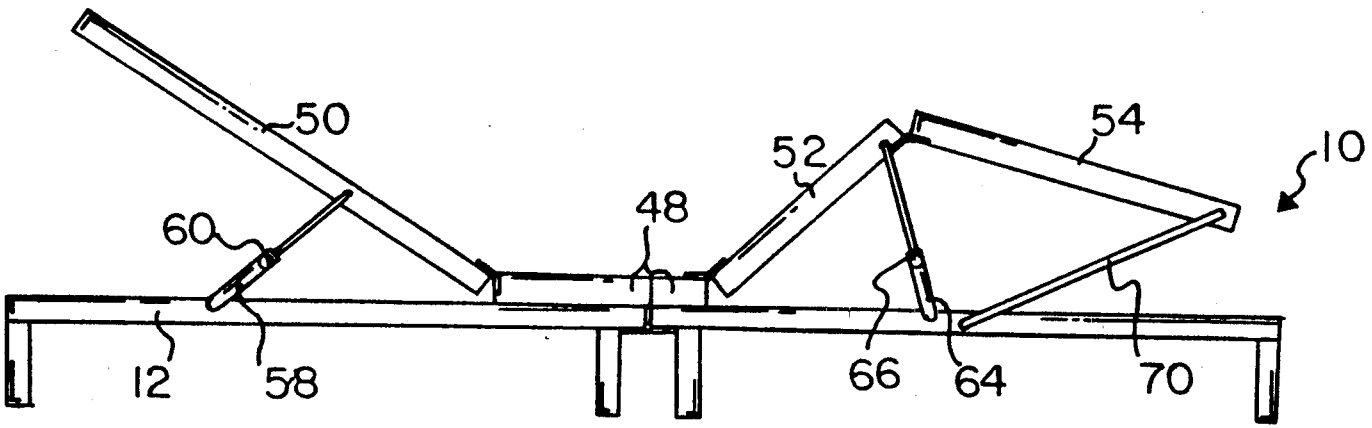
FIG. 4 is a side elevation of the primary embodiment of the bed with the body component and the leg component in a raised position.

Shown in FIGS. 1 through 4 and 6 through 9 are various views of the primary embodiment of the improved foldable bed 10 constructed in accordance with the principles of the preferred embodiment of the present invention.

From an overview standpoint, the foldable bed 10 is adapted for use by a human user for supporting a user and stimulating the supported user audially and tactilly. The device is completely portable and includes a lower assembly 12 formed of a leg section 14 and a body section 16, the lower assembly also includes foldable legs 20 extending therefrom. The bed further includes an upper assembly 22 having a leg component and a body component. Finally, the bed may include sound generating means 24 and 26 for imparting sound waves upon the user. Note FIG. 1.

More specifically, included in the foldable bed 10 is a lower assembly 12. The lower assembly is formed of a leg section 14 and a body section 16. Both the leg section and the body section comprise upper surfaces 28 and 30 and lower surfaces 32 and 34.

Figure 5:
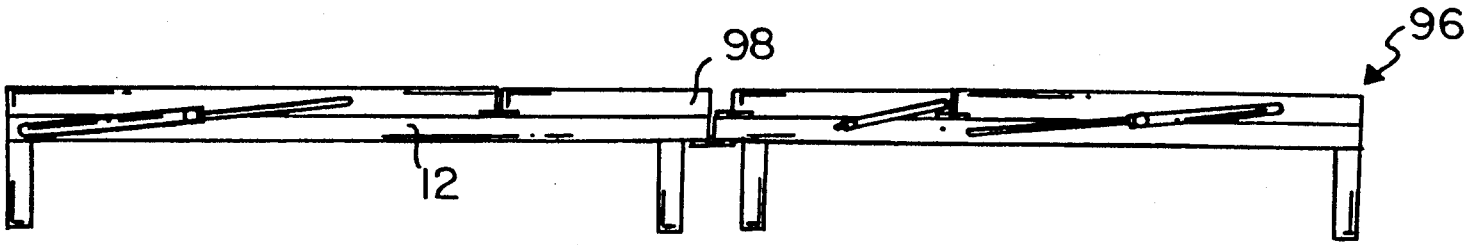
FIG. 5 is a side elevation similar to FIG. 3 of an alternate embodiment of the bed with the body component and the leg component in a lowered position.
Figure 6:
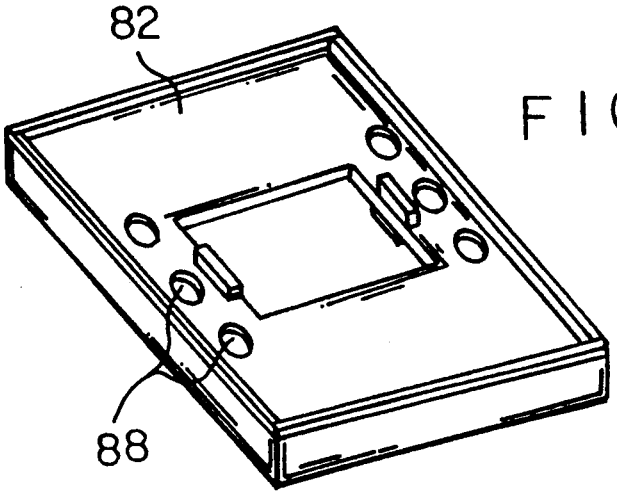
FIG. 6 is a perspective view of the variable volume body component speaker support structure.
Figure 7:
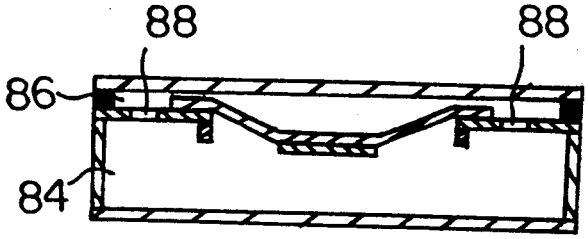
FIG. 7 is a cross sectional view of the variable volume body component speaker support structure.
Figure 9:
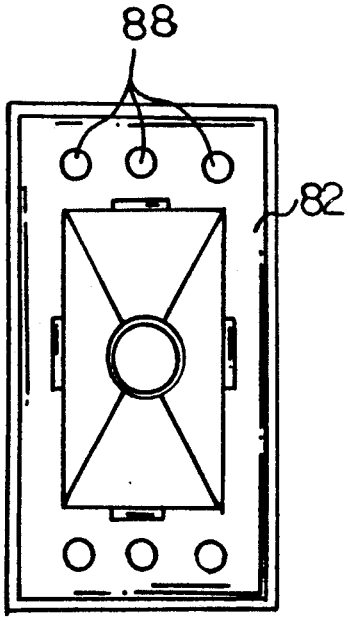
FIG. 9 is a top plan view of fixed volume speaker support structure of the body component.
Figure 8:
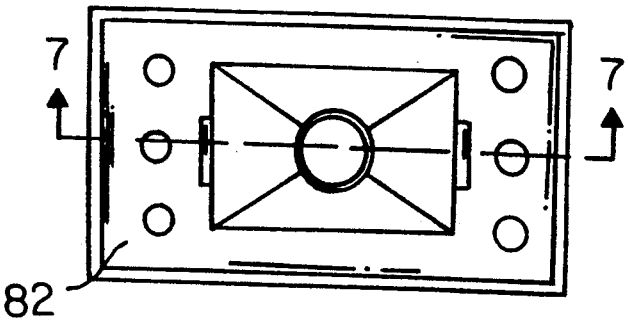
FIG. 8 is a top plan view of the variable volume speaker support structure of the calf component.
Figure 10:
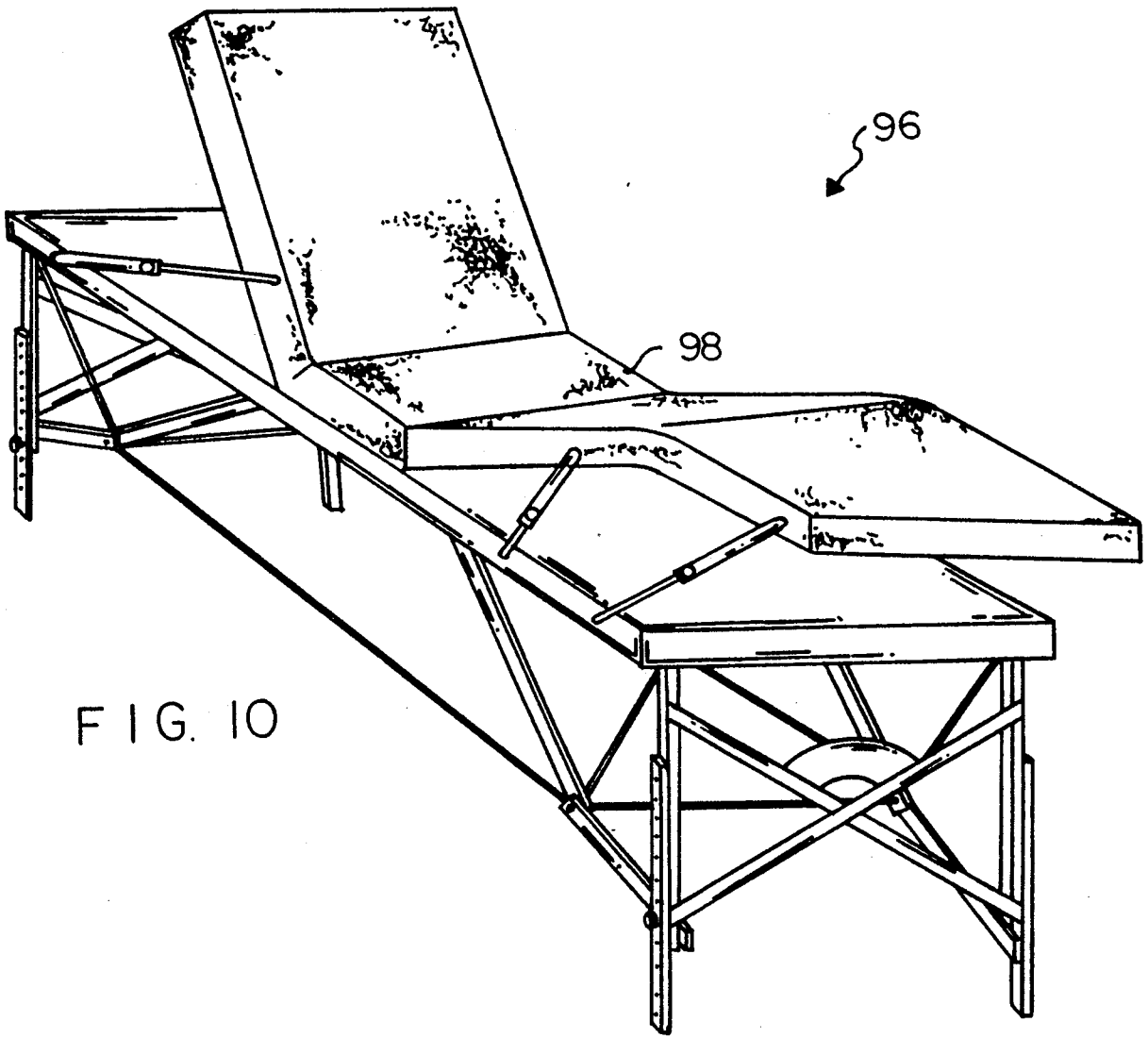
FIG. 10 perspective view of an alternate embodiment of the folding bed constructed in accordance with the principles of the present invention.

Further, a linear hinge 38 adjacent to the lower surfaces couples the leg section and the body section. The hinge permits for movement of the bed between an open orientation, (See FIGS. 3, 4 and 5) and a closed orientation (See FIG. 2). When the bed is in the open position the leg section and body section lie in a common horizontal plane. However, when the bed is in a closed orientation the leg section and body section lie parallel with each other. Further, when the bed is in the closed orientation the lower surfaces of the leg section and body section are located between the upper surfaces. The foldability of the sections about the hinge of the bed allows for easy transportation from one location to another location thereby allowing for portability never before achieved by a conventional bed.

The lower assembly further includes foldable legs 20. The foldable legs are movable on hinges between an open orientation and a closed orientation in a continual manner. When the legs are positioned in the open position the legs extend downwardly from the lower surface of the leg section and body section. When the legs are positioned in the closed orientation the legs lie parallel with the lower surfaces of the leg section and body section. The ability of the legs to move from an open position to a closed position allows the bed to fold into a compact shape that is easily transported from location to another. After the legs are moved into the closed position lying parallel with the lower surfaces of the leg section and body section, the leg section and body section are positionable parallel to one another to thereby create a very thin profile which makes the bed occupy a minimal amount of space. Note FIG. 2.

For supporting a recumbent or reclining user, an upper assembly 22 is provided. The upper assembly is formed of a body component 42 and a leg component 44. Both the leg component and the body component have an upper surface and a lower surface. The lower surfaces of the upper assembly are positionable on the upper surfaces of the lower assembly. Means such as screws are provided for coupling the upper assembly and lower assembly at a central region thereof.

The upper assembly further includes a fixed central extent 48. The fixed central extent located adjacent to the hinge. The central extent forms a horizontal bearing surface for the rear or buttocks of the user. In the preferred embodiment the leg component is of the same size and proportion as the body component combined with the central extent to allow the bed to be folded about the hinge for transportation thereof.

Additionally, a torso extent 50 further comprises the upper assembly. The torso extent is pivotally secured to the central extent over the body section. The torso extent is adapted to support a user in a reclining position. The torso extent may be articulated about pivotally coupling means to maximize comfort and support of the user. The articulation of the torso extent from a horizontal position to an inclined position provides a comfortable and efficient positioning of the user for eating, sleeping, watching television, relaxing, etc. Note FIGS. 1 and 4.

Further, the upper assembly has a thigh extent 52 adapted to support the thighs of the user. The thigh extent is pivotally secured to the central extent and positioned over the leg section. The thigh extent is able to articulate from a horizontal to inclined position and thereby supporting the user's legs in a manner that is both comfortable and healthful. Note FIGS. 1 and 4.

For supporting the calves of the user, the upper assembly also includes a calf extent 54. The calf extent is pivotally secured to the thigh extent. Further, the calf extent is positioned over the leg section. The calf extent is positionable in a range of positions from horizontal to declined to allow for maximum comfort and blood circulation. Note FIGS. 1 and 4. The medical profession has determined that when a reclining person has the calf portion of his legs higher than the spine portion, significant medical benefits result. This position is known as the Trendelenberg position.

The folding bed includes a first adjustment means 58. The first adjustment means couples the torso extent and the body section. Such adjustment means include a rod and cylinder on opposite sides of the bed which are pivotally secured at their opposite ends to the torso extent and the body section with locking means coupling the upper and lower parts of the rod and cylinder. A locking bolt 60, under the control of the user, allows extending or contracting the adjustment screw for maximum operator comfort. The first adjustment means varies the angle of the torso extent with respect to the body section.

A second adjustment means 64, is further included in the folding bed. The second adjustment means is provided for coupling the thigh extent and the leg section. Such adjustment means include a rod and cylinder on opposite sides of the bed which are pivotally secured at their opposite ends to the thigh extent and the body section with locking means 66 coupling the upper and lower parts of the rod and cylinder. A locking bolt, under the control of the user, allows extending or contracting the adjustment screw for maximum operator comfort. The second adjustment means varies the angle of the thigh extent with respect to the leg section.

Finally, the bed comprises a third adjustment means. The third adjustment means couples the calf extent and the leg section. Such adjustment means include rods 70 on opposite sides of the bed which are pivotally secured at their upper and lower ends to the calf extent and the body section. These rods are of a fixed length for moving with the movement of the thigh extent. The lower ends are removable from the lower section when not in use to facilitate movement into the closed position. The third adjustment means permits the angle of the calf extent to vary with respect to the leg section and thigh extent when the thigh extent is moved. Note FIGS. 3 and 4.

The folding bed further includes a covering means 74. The covering means is associates with the upper assembly. The covering means further includes a cushioning pad 76, or preferably separate pads for the body component and leg component, overlying the upper surfaces of the upper assembly. Additionally, a single cloth 78 encompasses essentially the entire upper assembly including the pad. In the preferred embodiment the cushioning pad is 2" inches of foam plus or minus 10% and the cloth is fabric with a mattress-like ticking or cushion material on the upper surface thereof.

Additionally, the folding bed comprises speakers 24 and 25 in the torso panel and calf panels. A baffle 82 is provided for supporting each speaker. A fixed volume air space 84 is provided beneath each baffle and a variable volume air space 86 is provided above each baffle. Apertures or holes extends through the baffle. The aperture tends to equalize the pressures in the spaces on opposite sides of the baffle during the generation of sound waves by the speaker. The use of the apertures allows the variable volume air space to vibrate and the fixed volume air space to remain constant.

In use it has been found that excess materials above the speakers can have a tendency to dampen the extent of sound emanating upwardly toward the user. This effect is because the vibratory waves generated by the speakers will affect the change of volume in air between the fixed volume and variable volume spaces. The apparatus allow the lower surfaces of the torso extent and calf extent to vibrate with more fidelity with regard to the generated sound waves to allow more sound waves to emanate upwardly toward the user as well as stimulation of the user by the sound waves. When the user is seated in the bed, the user may audially and tactically enjoy the created sound by the speakers. In the preferred embodiment the speakers are in the 10–40 watt category.

Further details of the speakers and related components can be had by reference to my patents, U.S. Pat. Nos. 5,097,821 and 5,143,055, as well as my co-pending application U.S. patent application Ser. No. 07/938,395 filed in Aug. 31, 1992 still pending. The subject matter of such patents and application is incorporated herein by reference.

Further, the central extent 48 and thigh panel 52 constitute an acoustical baffle between the two speakers. Therefore, sound waves produced in the torso extent do not influence sound waves in the calf extent. Similarly, sound waves in the calf extent do not influence sound waves in the torso extent. The baffle allows the intensity of vibrations imparted on the user to be more precisely tailored to the individual user's needs.

For providing sound waves for audial enjoyment of the user, the folding bed further includes a pair of supplemental speakers 92. The supplemental speakers are laterally spaced in the torso extent and positioned at the end thereof remote from the central extent. The supplemental speakers directly provide music to the user for listening enjoyment from the music that is used to create the vibrations emanating from the speaker means in the torso extent and calf extent.

For varying the operation of the speaker means an operator-controlled 94 is included in the folding bed. The operator-controlled means is positioned in the central extent of the folding bed for easy access and operation by the user or an attendant. The panel includes knobs for off/on control as well as for volume and tone as well as a dial for changing stations, whether AM or FM. Also included is a cassette player to extend the enjoyment of a user. Therefore, when positioned in the folding bed, the user or attendant may audially and tactically enjoy the created sound. Further, the levels of sound waves emitted from the torso extent, calf extent and supplemental speakers may be adjusted as required for optimal use of the folding bed.

The primary embodiment of the folding bed comprises a central extent that is split along a line overlying the hinge. The split line allows for the body section and leg section to be of a similar shape and size. The split overlying the hinge provides for movement of the bed between an open orientation and a closed orientation in such a configuration that when the bed is closed the equally sized leg section and body section lie parallel with the free ends of the sections meeting. Further, the foldability of the sections about the hinge and split line of the bed allows for easy transportation from on location to another location due to optimal placement of the hinge and split line for efficient folding of the bed.

An alternate embodiment of the folding bed 96 comprises a central extent 98 is located entirely over one of the sections of the lower assembly. This arrangement provides for a bed of a simple design with less components, the unitary central extent, that will fold about a linear hinge permitting for movement of the bed between an open orientation and a closed orientation. When the bed is in a closed orientation, the leg section and body section lie parallel with each other. The length of each half of the bed is the same on each side of the hinge in the primary embodiment. In the alternate embodiment, such halves may be of different lengths.

No special materials are required for construction of this folding bed. The lower assembly and upper assembly are preferably wooden, or alternatively plastic, metal of composite of equivalent rigidity. The resilient material on which the back, seat and legs of a user on the folding bed are supported may be suitably durable elastomer, such as natural or synthetic rubber or foamed polyalkylene, polyurethane, or the like. Further, although the present invention is disclosed as being embodied in a bed, such invention could readily be adapted to lounges, chairs, beach chairs, or the like.

The present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

Now that the invention has been described,

What is claimed is:

1. A foldable bed with sound generating capabilities comprising, in combination:

a lower assembly formed of a leg section and a body section, each section having an upper surface and a lower surface, a linear hinge coupling the sections for movement between an open orientation wherein the sections lie in a common horizontal plane and a closed orientation wherein the sections lie parallel with each other, the lower assembly also including foldable legs movable between an open orientation wherein the legs extend downwardly from the lower surface and a closed orientation wherein the legs lie parallel with the lower surface;

an upper assembly formed of a leg component and a body component, each component having an upper surface and a lower surface, the lower surface of the upper assembly positionable on the upper surface of the lower assembly with means to couple the upper and lower assemblies at a central region thereof, the upper assembly having a fixed central extent with a separation line overhanging the hinge, the upper assembly also having a torso extent pivotally secured to the central extent over the body section, the upper assembly also having a thigh extent pivotally secured to the central extent over the leg section, the upper assembly also having a calf extent pivotally secured to the thigh extent over the leg section;

first adjustment means coupling the torso extent and the body section to vary the angle of the torso extent with respect to the body section, second adjustment means coupling the thigh extent and the leg section to vary the angle of the thigh extent with respect to the leg section, third adjustment means coupling the calf extent and the leg section to vary the angle of the calf extent with respect to the leg section and thigh extent;

covering means associated with the upper assembly including a cushioning pad overlying the upper surfaces of the upper assembly and a single cloth encompassing essentially the entire upper assembly including the pad; and a sound generating device in both the torso extent and the calf extent with the central extent and thigh extent forming an acoustical barrier therebetween, each sound generating device including a speaker with a baffle supporting the speaker and aperture means extending through the baffle tending to equalize the pressures in the spaces on opposite sides of the baffle.

2. A foldable bed comprising, in combination:

a lower assembly formed of a leg section and a body section, each section having an upper surface and a lower surface, a linear hinge coupling the sections for movement between an open orientation wherein the sections lie in a common horizontal plane and a closed orientation wherein the sections lie parallel with each other with the lower surfaces located between the upper surfaces, the lower assembly also including foldable legs movable between an open orientation wherein the legs extend downwardly from the lower surface and a closed orientation wherein the legs lie parallel with the lower surface;

an upper assembly formed of a leg component and a body component, each component having an upper surface and a lower surface, the lower surface of the upper assembly positionable on the upper surface of the lower assembly with means to couple the upper and lower assemblies at a central region thereof, the upper assembly having a fixed central extent adjacent to the hinge, the upper assembly also having a torso extent pivotally secured to the central extent over the body section, the upper assembly also having a thigh extent pivotally secured to the central extent over the leg section, the upper assembly also having a calf extent pivotally secured to the thigh extent over the leg section; and first adjustment means coupling the torso extent and the body section to vary the angle of the torso extent with respect to the body section, second adjustment means coupling the thigh extent and the leg section to vary the angle of the thigh extent with respect to the leg section, third adjustment means coupling the calf extent and the leg section to vary the angle of the calf extent with respect to the leg section and thigh extent.

3. The device as set forth in claim 2 and further including covering means associated with the upper assembly including a cushioning pad overlying the upper surfaces of the upper assembly and a single cloth encompassing essentially the entire upper assembly including the pad.

4. The device as set forth in claim 2 and further including at least one speaker means in one of the extents.

5. The device as set forth in claim 4 and further including operator-controlled means in the central extent for varying the operation of the speaker means.

6. The device as set forth in claim 4 and further including a pair of supplemental speakers laterally spaced in the torso extent at the end thereof remote from the central extent.

7. The device as set forth in claim 2 and further including two speaker means each in a separate extent.

8. The device as set forth in claim 7 wherein the central extent constitutes an acoustical baffle between the two speaker means.

9. The device as set forth in claim 2 and further including a speaker means in the torso and calf extents with the central and thigh extents constituting acoustical baffle means.

10. The device as set forth in claim 2 and further including a plurality of speakers in separated extents, a baffle supporting each speaker, a fixed volume air space beneath each baffle and a variable volume air space above each baffle and aperture means extending through the baffle tending to equalize the pressures in the spaces on opposite sides of the baffle during the generation of sound waves by the speaker.

11. The device as set forth in claim 2 wherein the central extent is split along a line overlying the hinge.

12. The device as set forth in claim 2 wherein the central extent is located entirely over one of the sections of the lower assembly.

* * * * *